United States Patent [19]

Schacht

[11] Patent Number: 4,923,197

[45] Date of Patent: May 8, 1990

[54] SET OF GOLF CLUBS

[75] Inventor: James Schacht, Clarksville, Tenn.

[73] Assignee: Floyd Horgen, Rockledge, Fla. ; a part interest

[21] Appl. No.: 258,215

[22] Filed: Oct. 14, 1988

[51] Int. Cl.[5] ..... A63B 53/00

[52] U.S. Cl. ..... 273/77 A; 273/169

[58] Field of Search ..... 273/77 A, 81 A, 80 A, 273/169, 170, 171, 172, 173, 174

[56] References Cited

U.S. PATENT DOCUMENTS

| | | | |
|---|---|---|---|
| 1,696,462 | 12/1928 | Victor | 273/81 A |
| 3,984,103 | 10/1976 | Nix | 273/77 A |
| 4,461,479 | 7/1984 | Mitchell | 273/77 A |
| 4,674,324 | 6/1987 | Benoit | 273/77 A |
| 4,679,791 | 7/1987 | Hull | 273/77 A |

OTHER PUBLICATIONS

"Golf Club Design, Fitting, Alteration and Repair", by Ralph Maltby, pp. 418 and 420 (1982).

"One Swing" Irons, Golf Digest, Dec., 1967, p. 20.

"One Swing" Woods, Golf Digest, Oct. 1968, p. 16.

*Primary Examiner*—George J. Marlo

*Attorney, Agent, or Firm*—Stephen T. Belsheim

[57] ABSTRACT

A set of golf club irons including a plurality of clubs of a common length, lie and head weight comprising a basis club wherein the length, lie and head weight of the basis club is the same as its conventional counterpart club, said basis club having a preselected loft; a second club having a loft greater than the preselected loft of the basis club, said second club having a weight distribution oriented more toward the top edge of the club head than its conventional counterpart.

6 Claims, 2 Drawing Sheets

SET OF GOLF CLUBS

BACKGROUND OF THE INVENTION

The invention relates to an improved set of golf clubs, and more specifically, to an improved set of iron golf clubs having a common club weight, length and lie.

Under current rules of the United States Golf Association, the governing body of golf in the United States, a golfer is permitted to carry a maximum of fourteen clubs in his or her bag during a round of golf. Typically, a set of golf clubs will include a putter and three to four wood clubs and nine to ten iron clubs. In a conventional set, the length, lie and club weight for each of the golf clubs is different. Most manufacturers vary the individual club lengths by one half inch with the lowest number club having the longest length. For example, a typical nine iron is about 35½ inches long, and a typical eight iron is about 36 inches long. A typical one iron is about 39½ inches long.

In a typical set, the manufacturer, in addition to varying the length of each club in a set, also, varies the lie of each club. Longer irons have flatter lies, i.e. a smaller included angle between a plane parallel to the sole of the club and the longitudinal axis of the shaft than do shorter iron. For example, a nine iron is shorter and a more vertical club than a one iron. As can be appreciated, the golfer typically stands varying distances from the ball with different iron clubs. As also can be appreciated, because each iron club is different, the golfer will swing each club in a different fashion.

Typical golf clubs presently on the market present club heads of decreasing weight as the clubs get longer. For example, the head of a two iron will weigh less than the head of a nine iron.

Thus, in conventional sets marketed today, one sees that each club will have a different club head weight, different club shaft length, different lie and different total club weight. The combination of all these factors requires the golfer to take a different stance, and thus, a different swing, at least to some degree, for each club. As can be appreciated, this impedes achieving a high level of perfection since the golfer must train his muscles to "remember" (through muscle memory) at least thirteen different stances and swings so as to accommodate each golf club. It is only through long and dedicated practice that a golfer achieves a high level of competence which explains why most amateur golfers hit good and bad shots with the same club and why an amateur golfer will typically strike one or two clubs better than the remainder of the clubs in his or her bag.

In the past, persons have sought to overcome the abovementioned variables in golf club design. For example, U. S. Pat. No. 3,984,103 to Nix entitled "Matched Golf Club Set" which issued Oct. 5, 1976, discloses a set of golf clubs wherein both the woods and irons, have a common length and a common lie. As another example, U.S. Pat. No. 4,679,791 to Hull for a "Set of Golf Clubs" which issued July 14, 1987, discloses a set of golf clubs, comprising both woods and irons, having a common length, lie and weight.

While the sets of golf clubs disclosed in U.S. Pat. No. 3,984,103 to Nix and U.S. Pat. No. 4,679,791 to Hull may comprise an improvement over conventional clubs now marketed, the clubs disclosed by both of these patents do not provide a set of clubs whereby for each club the trajectory, i.e. the flight pattern of the ball, matches that when struck by a conventional club.

More specifically, it has been found that when playing a set of golf clubs such as those disclosed in U.S. Pat. No. 4,679,791 to Hull, that the nine iron when properly struck flies extraordinarily high compared to the flight of a ball struck with a conventional nine iron. It has also been found for a set of golf clubs like those of Hull that a ball struck with a two iron (of the Hull set of clubs) travels in an extraordinarily low flight pattern when compared to a ball struck with a conventional two iron.

As can be appreciated, the difference in flight patterns between well struck shots with conventional clubs and well struck shots with clubs from a set of clubs such as those of Hull have caused golfers some concern. Golf courses are designed whereby, on occasion, golfers must carry the ball on the fly over a hazard for a great length. Consequently, a long iron (for example a two iron) that could not be well struck and achieve a height equal to that of a ball well struck with a conventional two iron is undesirable. In a like fashion, there occurs instances when a golfer wants to hit a higher lofted club, such as a nine iron, on a relatively low trajectory. If a well struck short iron, such as a nine iron, has a flight trajectory that is extraordinarily high, it can be appreciated that the shot may be unduly affected by wind or be unable to fly underneath tree limbs or the like. The ability to successfully hit a so-called "punch shot" with a pitching wedge or other greater lofted club of the Hull set of clubs is limited by the clubs themselves. It is therefore apparent that a set of golf clubs, such as those to Hull or Nix, has built-in disadvantages.

SUMMARY OF THE INVENTION

Therefore, it is a principal object of the invention to provide an improved set of golf clubs.

It is another object of the invention to provide an improved set of golf clubs having a common club weight, length and lie.

It is another object of the invention to provide an improved set of golf clubs having a common club weight, length and lie wherein each club when well struck imparts to the ball a flight pattern that is similar to a ball well struck by its counterpart conventional club, which would be a golf club of the same loft.

In one form thereof, the invention is a set of golf club irons including a plurality of clubs of a common length, lie and head weight comprising a basis club wherein the length, lie and head weight of the basis club is the same as its conventional counterpart club, said basis club having a preselected loft. The set further includes a second club having a loft greater than the preselected loft of the basis club, said second club having a weight distribution oriented more toward the top edge of the club head than its conventional counterpart.

In another form, the invention is a set of golf club irons including a plurality of golf clubs having a common length, lie and weight comprising a medium iron club having the length, lie, weight and loft of its convention counterpart golf club. The set further includes a long iron having a loft less then that of the basis club, said long iron having a lie, length and weight equal to that of the basis club. The set further includes a short iron having a loft greater than that of the basis club, said short iron having a lie, length and weight.

BRIEF DESCRIPTION OF THE DRAWINGS

The above-mentioned and other features and objects of the invention, and the manner of attaining them, will become more apparent and the invention itself will be better understood by reference to the following description of a specific embodiment of the invention taken in conjunction with the appended drawings, wherein.

DETAILED DESCRIPTION OF A SPECIFIC EMBODIMENT

Referring to FIGS. 1 through 12, there is illustrated representative iron clubs from a matched set of irons comprising a specific embodiment of the present invention. A typical complete matched set of irons comprises a 1 iron through a 9 iron, a pitching wedge and a sand wedge. In recent years, some sets have even included a so-called third wedge having a loft greater then a conventional sand wedge. A set of irons can be selected for a particular golfer so as to comprise, for example, a 3 iron through 9 iron, pitching wedge and sand wedge. This invention is directed to a set of irons, whatever the makeup, and should not be limited to a set of irons of a specific makeup.

Figure 1:
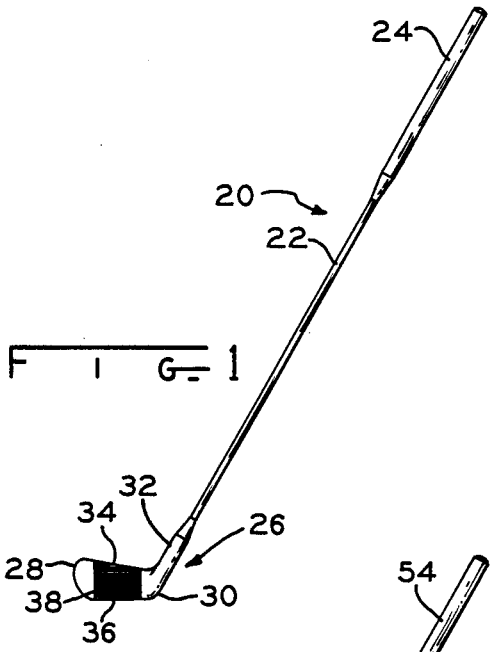
FIG. 1 is a front view of a long iron, such as a two, three or four iron.
Figure 2:
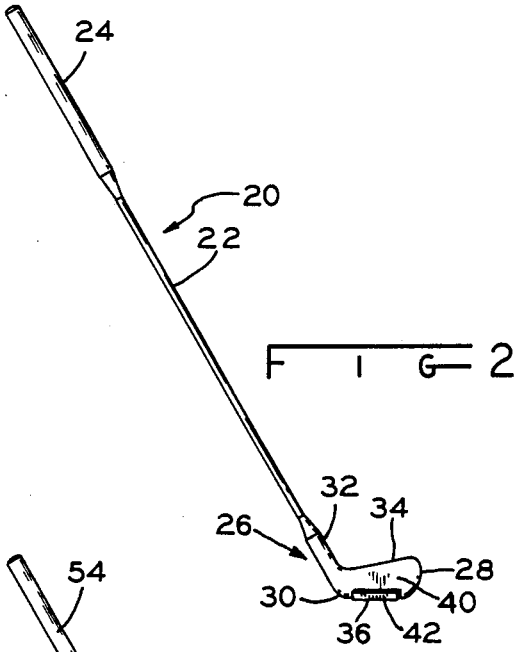
FIG. 2 is a rear view of a long iron, such as a two, three or four iron.

FIGS. 1 and 2 illustrate a so-called long iron, generally designated as 20, from a matched set of irons. A long iron may comprise a 1 iron, 2 iron or 3 iron. The long iron 20 illustrated in FIGS. 1 and 2, 7 and 8 comprises a golf shaft 22 having a grip 24 portion at one thereof and a head portion, generally designated as 26, at the other end thereof. The head portion 26 is described in more detail below.

The head portion 26 includes a toe 28, a heel 30 and a hosel 32. The hosel 32 contains a bore (not illustrated) into which the other end of the golf shaft 22 is received. Head 26 further includes a top edge 34 and a bottom edge or sole 36. The iron head 26 also has a front surface (or face) 38 for striking the golf ball, and an opposite rear surface (or back) 40.

As mentioned earlier, it has been found that a matched set of golf club irons may have the same (or common) lie, length and head weight with the only distinction between each iron of the set being the loft of the iron. The problem with this type of a set of golf club irons is that for each club, except the basis club, the flight characteristics of a golf ball struck therewith do not resemble those of a golf ball struck with a conventional counterpart golf club. It is very apparent that this inability to achieve a conventional flight trajectory is a meaningful drawback with this earlier set of clubs. It is a drawback which the present invention overcomes.

In regard to the so-called basis club, the basis club of the present invention is that club which is essentially a conventional golf club. The lie, length and weight of the basis club will dictate the lie, length and weight of the other golf clubs of the set. In other words, if a 6 iron is the basis club, the 6 iron of the present set will take on the characteristics of a conventional 6 iron, but the remainder of the irons will also take on the length, lie and weight of the conventional 6 iron (the basis club). The basis club does not have to comprise a 6 iron, but could be any other club. For example, a 5 iron could be the basis club. Typically, a medium iron will be the basis club.

In the case of long irons having the length, lie and head weight of a medium iron, such as a 6 iron, if the basis club is a 6 iron, the flight trajectory is typically lower than that of a golf ball struck with a conventional long iron. This is an undesirable characteristic. In order to overcome this deficiency, the present invention provides a long iron that has additional weight distributed near the sole 36 of the iron head 26. In this regard, FIG. 2 illustrates the rear surface 40 of the iron head 26 having a weight 42 positioned near the sole 36. The long iron head 26 has additional weight added in an amount sufficient to make the head weight of the iron head 26 greater than the weight of a conventional long iron head.

It should also be appreciated that more weight is added to a conventional 1 iron than to a conventional 2 iron, and more weight is added to a conventional 2 iron than a conventional 3 iron. This is true because the conventional 1 iron head is lighter then a conventional 2 iron head, and a conventional 2 iron head is lighter than a conventional 3 iron head.

The vertical positioning of the weight 42 varies between the long irons. The long iron illustrated in FIGS. 1 and 2 carries the weight 42 on the rear surface 40 near the sole 36. If this is the position for the 1 iron, then the 2 iron will carry the weight a little higher on the rear surface 40 that the 1 iron, and the 3 iron will carry the weight a little higher on the rear surface than the 2 iron.

FIGS. 3 and 4, 9 and 10 illustrate a so-called medium iron, generally designated as 50, from a matched set of irons. A medium iron may comprise a 4 iron, 5 iron or 6 iron. The medium iron 50 illustrated in FIGS. 3 and 4 comprises a golf shaft 52 having a grip 54 portion at one thereof and a head portion, generally designated as 56, at the other end thereof. The head portion 56 is described in more detail below.

The head portion 56 includes a toe 58, a heel 60 and a hosel 62. The hosel 62 contains a bore (not illustrated) into which the other end of the golf shaft 52 is received. Head 56 further includes a top edge 64 and a bottom edge or sole 66. The iron head 56 also has a front surface (or face) 68 for striking the golf ball, and an opposite rear surface (or back) 70. In the case of medium irons having the length, lie and head weight of one preselected medium iron (the basis club), such as a 6 iron, the flight trajectory is typically lower for less lofted medium irons (such as the 4 iron and 5 iron) and higher for more lofted clubs (such as a 6 iron if a 5 iron is the basis club) than that of a golf ball struck with a conventional medium iron whose lie, length and weight are selected as the basis for the set.

This is an undesirable characteristic. In order to overcome this deficiency, the present invention provides a group of medium irons that have the weighting thereof adjusted and distributed so that each iron provides flight characteristics like those of its conventional counterpart iron. More specifically, if the basis iron is a 6 iron, then the 4 iron will contain a weight positioned toward the sole 86 of the iron head 76, but the weight is not as close to the sole as that of the 3 iron.

Figure 3:
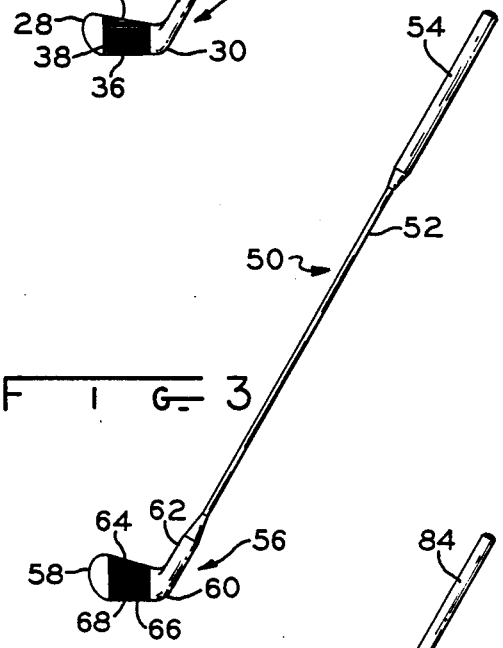
FIG. 3 is a front view of a medium iron, such as a five, six, or seven iron.
Figure 4:
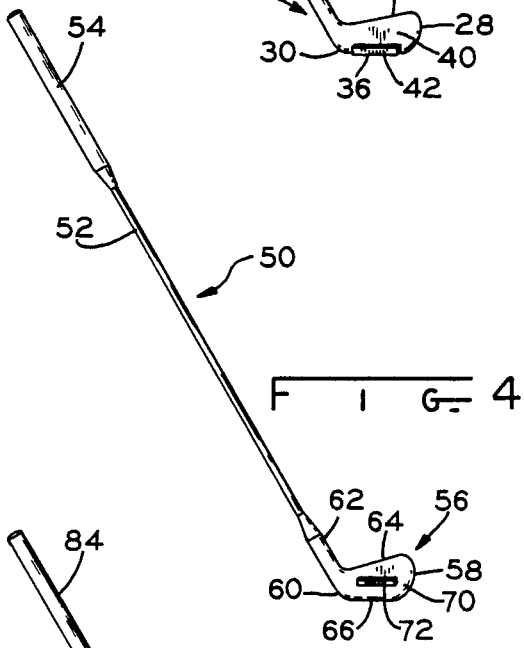
FIG. 4 is a rear view of a medium iron, such as a five, six, or seven iron.
Figure 5:
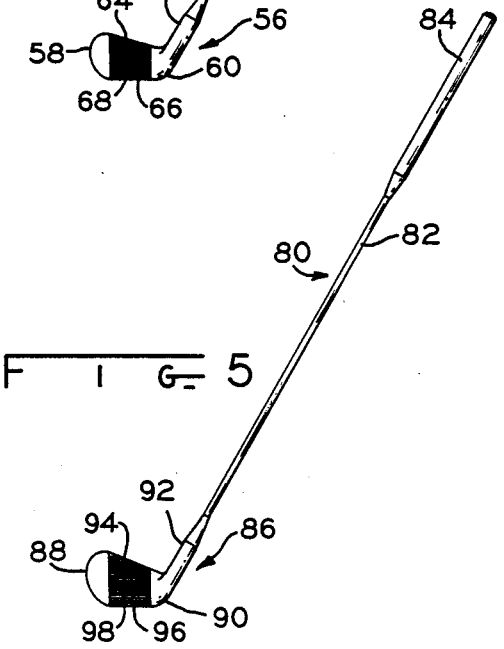
FIG. 5 is a front view of a short iron, such as an eight iron, nine iron or wedge

In this regard, FIG. 4 illustrates the rear surface 70 of the iron head 56 having a weight 72 positioned intermediate the sole and the top edge of the iron club head. For example, if the iron illustrated in FIGS. 3 and 4 is a 6 iron, the 4 iron and 5 iron will each have the weight 72 positioned closer to the sole. The weight 72 of the 4 iron will be positioned closer to the sole than the weight 72 of the 5 iron.

The medium iron head 56 (for the 4 and 5 irons if the basis iron is the 6 iron) each have additional weight added in an amount sufficient to make the head weight of each iron head 56 greater then that of its conventional counterpart iron.

It should also be appreciated that more weight is added to a conventional 4 iron than to a conventional 5 iron, and no weight is added to a conventional 6 iron if it is the basis iron. This is true because the conventional 4 iron head is lighter then a conventional 5 iron head, and the basis iron is intended to present characteristics like its conventional counterpart.

FIGS. 5 and 6, 11 and 12 illustrate a so-called short iron, generally designated as 80, from a matched set of irons. A short iron may comprise a 7 iron, 8 iron, 9 iron or a wedge (pitching and sand). The short iron 80 illustrated in FIGS. 5 and 6 comprises a golf shaft 82 having a grip 84 portion at one thereof and a head portion, generally designated as 86, at the other end thereof. The head portion 86 is described in more detail below.

The head portion 86 includes a toe 88, a heel 90 and a hosel 92. The hosel 92 contains a bore (not illustrated) into which the other end of the golf shaft 82 is received. Head 86 further includes a top edge 94 and a bottom edge or sole 96. The iron head 86 also has a front surface (or face) 98 for striking the golf ball, and an opposite rear surface (or back) 100.

In the case of short irons having the length, lie and head weight of a medium iron, such as a 6 iron (which can be considered the basis iron), the flight trajectory is typically higher than that of a golf ball struck with a conventional short iron.

Figure 6:
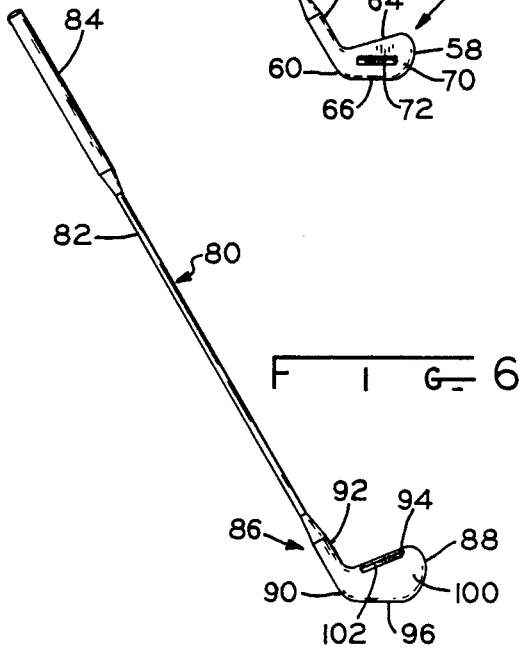
FIG. 6 is a rear view of a short iron, such as an eight iron, nine iron or wedge.
Figure 11:
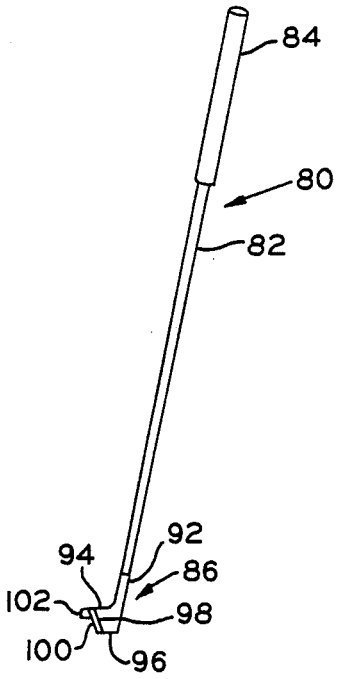
FIG. 11 is a side view of the short iron of FIGS. 5 and 6.
Figure 9:
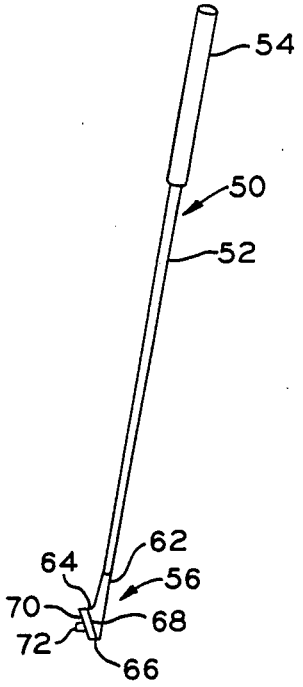
FIG. 9 is a side view of the medium iron of FIGS. 3 and 4.
Figure 7:
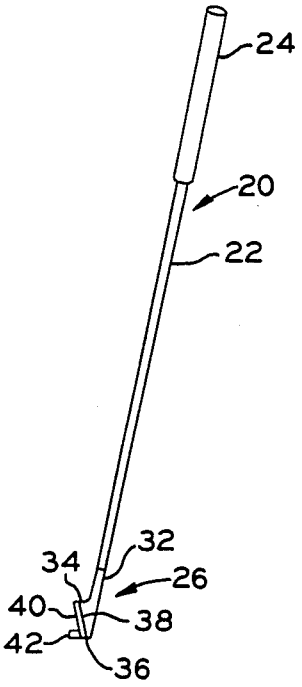
FIG. 7 is a side view of the long iron of FIGS. 1 and 2.

This is an undesirable characteristic. In order to overcome this deficiency, the present invention provides a short iron that has additional weight distributed near the top edge 94 of the iron head 86. In this regard, FIG. 6 illustrates the rear surface 100 of the iron head 86 having a weight 102 positioned near the top edge 94. The short iron head 86 has weight removed in an amount sufficient to make the head weight of the iron head 86 less then that of a conventional short iron.

It should also be appreciated that more weight is removed from a conventional 9 iron than from a conventional 8 iron, and more weight is removed from a conventional 8 iron than from a conventional 7 iron. This is true because the conventional 9 iron head is heavier then a conventional 8 iron head, and a conventional 8 iron head is heavier than a conventional 7 iron head.

The vertical positioning of the weight 102 varies between the short irons. The short iron illustrated in FIGS. 5 and 6 carries the weight 102 on the rear surface 100 near the top edge 94. If this is the position for the 9 iron, then the 8 iron will carry the weight a little lower on the rear surface 100 than the 9 iron, and the 7 iron will carry the weight a little lower on the rear surface than the 8 iron.

Figure 12:
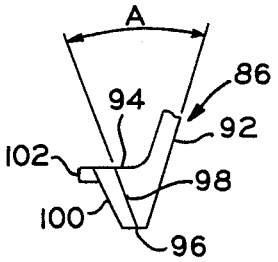
FIG. 12 is a side view of the iron head of FIG. 12.
Figure 10:
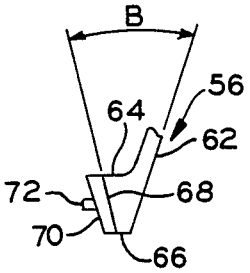
FIG. 10 is a side view of the iron head of FIG. 9.
Figure 8:
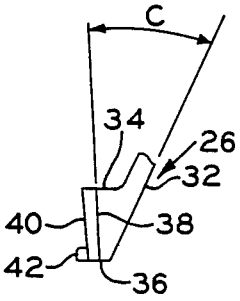
FIG. 8 is a side view of the iron head of the long iron of FIG. 7.

As can be appreciated, the specific amount of weight and the specific location will depend on the nature of the club design. The invention is intended to cover all types of iron designs including, but not limited to, conventional irons, heel-toe weighted irons and perimeter weighted irons. The basic principle is, however, the same with all types of iron designs; namely, that the lower the loft of the iron head the weight will be greater and be positioned closer to the sole of the club head. Referring to FIGS. 8, 10 and 12, one sees that the loft (angle A) of the short iron 80 is greater than the loft (angle B) of the medium iron 50 which, in turn, is greater than the loft (angle C) of the long iron 20. One also notes that the clubhead center of gravity is lower with less loft.

While this invention has been described as having a preferred specific embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A set of golf club irons including a plurality of successive clubs of a common length, lie and head weight comprising:

a first club having a preselected length, lie, head weight and loft;

a second club having a loft greater than the preselected loft of the first club, said second club having a club head with the weight of said club head distributed more toward the top edge thereof than said first club.

2. The set of golf clubs of claim 1 further including a third golf club having a loft less than the preselected loft of the first club, said third club having a club head with the weight of said club head distributed more toward the sole thereof than said first club.

3. The set of golf clubs of claim 1 wherein the first club is a six iron.

4. The set of golf clubs of claim 1 wherein the first club is selected from the group consisting of a four iron, a five iron, a six iron and a seven iron.

5. A set of golf club irons each having a common length, lie and weight, the set comprising:

a first iron club including a shaft with a grip affixed at one end thereof and a iron head affixed at the other end thereof, said iron head having a first loft and a first center of gravity; and a second iron club including a second shaft with a second grip affixed at one end thereof and a second iron head affixed at the other end thereof, said second iron head having a second loft greater than the first loft and a second center of gravity higher than the first center of gravity.

6. The set of golf club irons of claim 5 further including a third golf club iron including a third shaft with a third grip affixed at one end thereof and a third iron head affixed to the other end thereof, said third iron head having a third loft less than the first loft and a third center of gravity lower than the first center of gravity.

* * * * *